United States Patent [19]

Houle

[11] Patent Number: 4,830,724

[45] Date of Patent: May 16, 1989

[54] STAMPED METAL ANODE CAP ASSEMBLY

[75] Inventor: Timothy H. Houle, Wauwatosa, Wis.

[73] Assignee: A. O. Smith Corporation, Milwaukee, Wis.

[21] Appl. No.: 87,209

[22] Filed: Aug. 20, 1987

[51] Int. Cl.[4] ..... C23F 13/00

[52] U.S. Cl. ..... 204/197; 204/286; 219/281

[58] Field of Search ..... 204/147, 148, 196, 197, 204/286, 297 R

[56] References Cited

U.S. PATENT DOCUMENTS

| | | | |
|---|---|---|---|
| 2,642,391 | 6/1953 | Wellman | 204/197 |
| 3,558,463 | 1/1971 | Strobach et al. | 204/197 |
| 3,867,274 | 2/1975 | Herman | 204/197 |
| 3,891,530 | 6/1975 | Alewitz | 204/197 |
| 4,224,126 | 9/1980 | Bidwell | 204/197 |

*Primary Examiner*—T. Tung

*Attorney, Agent, or Firm*—Andrus, Sceales, Starke & Sawall

[57] ABSTRACT

An anode cap assembly comprising a stamped metal cap having a generally cylindrical inner section and a closed outer section. An anode rod formed of a metal electronegative to steel is disposed in the cylindrical inner section and the steel core wire of the anode projects outwardly of the anode rod and is electrically connected to the outer section of the cap. The outer section of the cap preferably has a smaller cross sectional area than the inner section and is formed with a plurality of external flat surfaces to receive a wrench or tool. After assembly of the anode rod to the cap, threads can be rolled in the outer surface of the outer section of the cap so that the cap can be threaded to a spud welded to the outer surface of a tank.

9 Claims, 1 Drawing Sheet

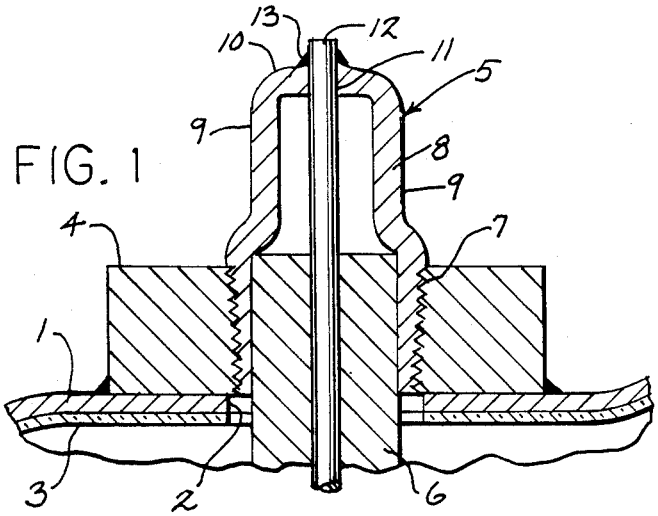
FIG. 1
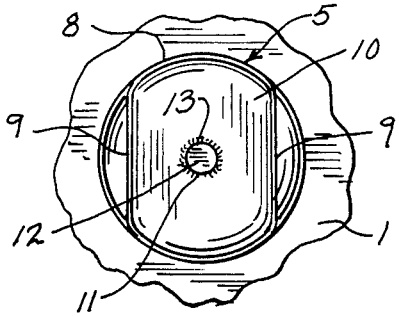
FIG. 2
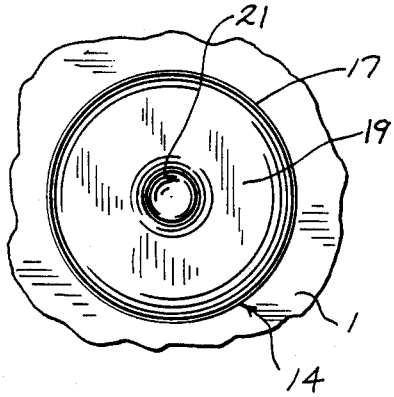
FIG. 4
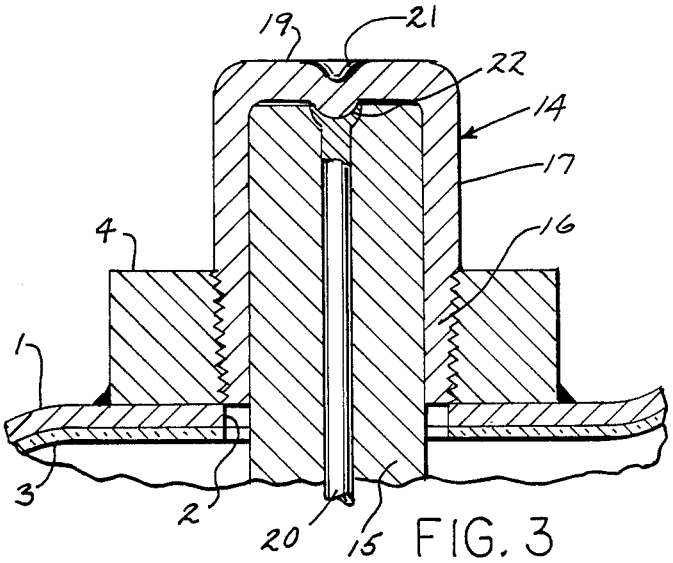
FIG. 3
FIG. 5
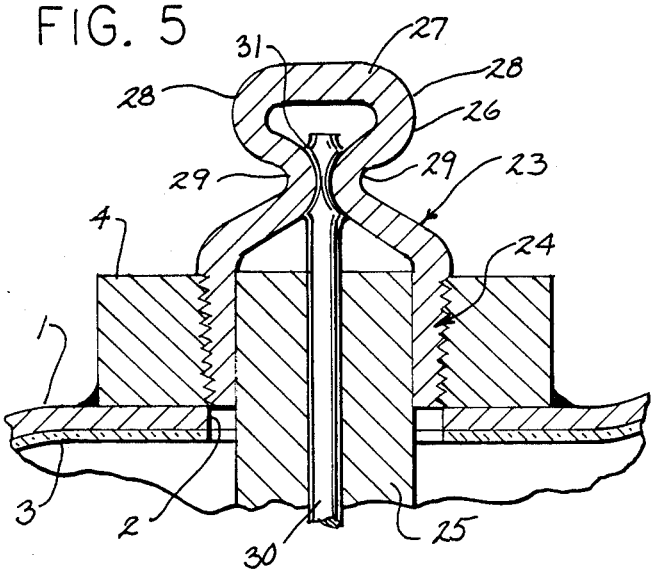
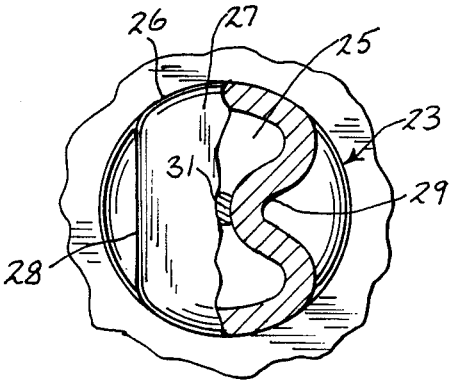
FIG. 6

STAMPED METAL ANODE CAP ASSEMBLY

BACKGROUND OF THE INVENTION

Water heaters normally include a steel tank to contain water to be heated, and to prevent corrosion of the steel tank, a corrosion resistant coating, such as glass or porcelain enamel, is applied to the inner surfaces of the tank which are exposed to the water. As intensified corrosion can occur through defects in the glass coating or in areas of the steel tank that may be inadequately coated, it is common practice to suspend an anode rod of a metal electropositive to steel, such as magnesium, aluminum or zinc, or in the tank. The anode, being electronegative to steel, will corrode preferentially to prevent corrosion of any areas of the steel tank exposed through the corrosion resistant coating.

To mount the anode rod in the tank, it is common practice to weld an annular, internally threaded spud to the outer surface of the tank head bordering an opening in the tank head. The anode rod, which is carried by a steel cap, is inserted through the opening in the tank head and the cap is threaded within the spud to mount the anode in the tank.

The conventional anode rod has a steel core wire and the upper end of the core wire projects beyond the corresponding end of the anode rod and is connected electrically to the cap either by welding or upsetting. With this construction, the anode rod will be suspended within the tank and will be electrically connected through the cap and spud to the tank wall.

The conventional anode cap, having a central axial opening to receive the anode rod, an enlarged head with wrench flats, the external threads, is manufactured from solid bar stock by machining operations which is a slow and costly procedure.

SUMMARY OF THE INVENTION

The invention is directed to an improved anode cap assembly comprising a stamped metal cap having an inner generally cylindrical section and a closed outer section. The outer end of an anode rod formed of a metal electropositive to steel is disposed within the open inner section, and the steel core wire of the anode rod is electrically connected to the closed outer section of the cap.

After assembly of the anode rod to the cap, threads can be rolled into the outer surface of the inner section of the cap so that the cap can be threaded to a spud that is secured to the outer surface of the tank bordering an opening in the tank head. The rolling operation also aids in providing a firm contact between the anode rod and the cap.

The outer section of the cap preferably has a smaller cross sectional area than the inner section and is formed with a plurality of external flat surfaces adapted to receive a wrench or tool to facilitate attachment of the cap to the spud.

In one form of the invention, the core wire of the anode rod extends through a hole in the outer section of the cap and is welded to the cap. In a second form of the invention, the outer end of the core wire is engaged with the inner surface of the cap and the cap is upset inwardly to provide a positive connection between the core wire and the cap.

In further modified form of the invention, the sides of the outer section of the cap are upset inwardly into contact with opposed sides of the core wire to provide a positive contact between the core wire and the cap.

The invention provides a less costly anode cap assembly formed by stamping and rolling operations which eliminates the costly machining operations as used in the past.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of a portion of a water heater incorporating the anode cap assembly of the invention;

FIG. 2 is a section taken along line 2—2 of FIG. 1;

FIG. 3 is a view similar to FIG. 1 showing a modified form of the invention;

FIG. 4 is a section taken along line 4—4 of FIG. 3;

FIG. 5 is a view similar to FIG. 1 showing the further modified form of the anode cap assembly; and FIG. 6 is a section taken along line 6—6 of FIG. 5.

DESCRIPTION OF THE ILLUSTRATED EMBODIMENT

The anode cap assembly of the invention is utilized to mount an anode rod in a tank and has particular application for mounting an anode rod in a water heater. FIG. 1 shows the upper head 1 of a conventional water heater tank and the head is provided with an opening 2. The inner surface of the tank can be coated with a corrosion resistant coating 3, such as glass or porcelain enamel.

As shown in FIG. 1, an annular steel spud 4 is welded to the outer surface of head 1 and is provided with an internally threaded central opening that is aligned with opening 2 in head 1.

A stamped steel cap 5 is supported by spud 4 and carries an anode rod 6 formed of a metal electropositive to steel such as aluminum, magnesium, zinc or alloys thereof.

The anode cap 5 of the invention includes a generally cylindrical inner section 7 and an outer section 8 which has a smaller cross sectional area than inner section 7. As best shown in FIG. 2, outer section 8 is provided with a pair of opposed flat surface 9 which constitute wrench flats and enable a wrench or a tool to grip the cap. While the drawings have shown a pair of wrench flats 9, it is contemplated that any desired number of flats can be incorporated.

The outer end of section 8 is closed off by a rounded head 10 having a central hole 11. The steel core wire 12 of anode rod 6 projects upwardly beyond the corresponding end of rod 6 and extends through hole 11. To provide a positive electrical connection between core wire 12 and cap 5, the outer end of core wire 11 is welded to the cap, as indicated by 13.

After assembly of anode rod 6, the outer surface of inner section 7 is threaded, preferably by a rolling operation. The rolling not only forms the threads to enable the cap to be threaded in spud 4, but also provides a firm mechanical interlock between the outer end of anode rod 6 and cap 5.

FIGS. 3 and 4 illustrate a modified form of the invention including a stamped steel cap 14, which is adapted to support an anode rod 15.

Cap 14 includes a generally cylindrical threaded inner section 16 and an outer section 17. In this embodiment, outer section 17 is not formed with flats and the cap can be threaded in the spud 4 through use of a standard pipe wrench.

Core wire 20, which projects outwardly from the end of anode rod 15, is disposed in engagement with the inner surface of the rounded closed head 19 of cap 14. To provide a positive connection between the end of core wire 20 and cap 14, the central portion of head 19 is upset inwardly to form a depression 21 and a corresponding enlargement 22 at the outer end of core wire 20. The upsetting provides a positive connection between the core wire 20 and cap 14.

The outer surface of cylindrical section 16 is threaded and the threads are preferably formed by a rolling operation after attachment of the anode rod. The rolling operation provides the dual function of forming the threads as well as providing a mechanical interlock between the upper end of anode rod 15 and cap 14.

FIGS. 5 and 6 illustrate a further modified form of the invention in which the stamped steel cap 23 is provided with a generally cylindrical inner section 24, which receives the outer end of an anode rod 25, and an outer section 26 that terminates in a generally rounded head 27. As shown in FIG. 6, head 27 is provided with a pair of wrench flats 28 to receive a wrench or tool.

To provide a firm connection between the core wire 29 of anode 25 and cap 23, outer section 26 is bent or deformed inwardly at diametrically opposite locations, as indicated by 29, by an upsetting operation to bring the upset portions 29 into firm electrical contact with core wire 30. The upsetting also acts to mash the outer end of the core wire, as indicated by 31.

After attachment of the anode rod, threads are formed in the outer surface of inner section 24 in the manner previously described so that the cap can be threaded to spud 4.

The cap of the invention is formed by stamping, rolling and upsetting operations which eliminates the costly machining as used in the past.

Various modes of carrying out the invention are contemplated as being within the scope of the following claims particularly pointing out and distinctly claiming the subject matter which is regarded as the invention.

I claim:

1. An anode assembly comprising a stamped steel cup-shaped cap having an open generally cylindrical inner section and a closed outer section, the outer surface of said inner section being threaded, an anode rod of a metal electronegative to steel having an end disposed in the open inner section of said cap, said end being secured in said open inner section by a mechanical interlock formed by a rolling operation, a steel core wire disposed centrally of said anode rod and having an end projecting outwardly of said end of said rod, connecting means for electrically connecting the projecting end of said core wire to said outer section, said outer section having a cross sectional area no greater than that of said inner section.

2. The assembly of claim 1, wherein said end of said anode rod is disposed at the junction between said inner and outer sections of said cap.

3. The assembly of claim 1, wherein said cap comprises a head, said connecting means comprises a hole in said head to receive said core wire, and a weld connecting said core wire to said head.

4. The assembly of claim 1, wherein said connecting means comprises an axial depression in said head, the outer end of said core wire being enlarged and being in contiguous relation with said depression.

5. The assembly of claim 1, wherein said connecting means comprises a plurality of radially inward depressions in said outer section disposed in engagement with said core wire.

6. The assembly of claim 1, wherein said outer section has a plurality of external flat surfaces disposed to receive a tool to facilitate threading of said cap to a tank.

7. An anode assembly, comprising a stamped steel cup-shaped cap having an open generally cylindrical inner section and a closed outer section, the outer surface of said inner section being threaded and the inner surface of said inner section being free of threads, an anode rod of a metal electronegative to steel having an end disposed in the open inner section of said cap, said end being connected to said open inner section by a mechanical interlock formed by a rolling operation, a steel core wire disposed centrally of said anode rod and having an end projecting outwardly of said end of said rod, means for electrically connecting the projecting end of said core wire to said outer section, said outer section having a smaller cross sectional area than said inner section and having a plurality of external flat surfaces disposed to receive a tool to facilitate threading of said cap to a tank.

8. The assembly of claim 7, wherein said metal is selected from the group consisting of aluminum, magnesium, zinc and alloys thereof.

9. In a water heater, a tank to contain water to be heated, said tank having an opening therein, an annular steel spud secured to the outer surface of said tank and having an internally threaded aperture aligned with said opening, a stamped steel cup-shaped cap having a generally cylindrical open inner section and a closed outer section, the outer surface of said inner end section being threadedly engaged with said threaded aperture, an anode rod of a metal electronegative to steel and having an end disposed in said open inner section, said end being connected to said open inner section by a mechanical interlock formed by a rolling operation, a steel core wire disposed centrally of said rod and having an end projecting outwardly of said end of said rod, means for electrically connecting the projecting end of said wire to said outer section of said cap, said outer section having a smaller cross sectional area than said inner section and having a plurality of external flat surfaces disposed to receive a tool to facilitate threading of said cap to said spud.

* * * * *